US005545014A

United States Patent [19]

Sundberg et al.

[11] Patent Number: 5,545,014

[45] Date of Patent: Aug. 13, 1996

[54] VARIABLE DISPLACEMENT VANE PUMP, COMPONENT PARTS AND METHOD

[75] Inventors: Jack G. Sundberg, Meriden; Bernard J. Bisson, Winsted; Mihir C. Desai, West Hartford; Martin T. Books, New Britain, all of Conn.

[73] Assignee: Coltec Industries Inc., New York, N.Y.

[21] Appl. No.: 114,253

[22] Filed: Aug. 30, 1993

[51] Int. Cl.[6] ..... F04B 23/10

[52] U.S. Cl. ..... 417/204; 418/26; 418/268

[58] Field of Search ..... 417/204; 418/26, 418/30, 268

[56] References Cited

U.S. PATENT DOCUMENTS

| | | | |
|---|---|---|---|
| 4,183,723 | 1/1980 | Hansen et al. | 417/204 |
| 4,222,712 | 9/1980 | Huber et al. | 417/204 |
| 4,354,809 | 10/1982 | Sundberg | 418/268 |
| 4,516,920 | 5/1985 | Shibuya | 418/268 |
| 4,913,636 | 4/1990 | Niemiec | 418/268 |
| 5,141,418 | 8/1992 | Ohtaki et al. | 418/30 |

*Primary Examiner*—Charles Freay

*Assistant Examiner*—William Wicker

*Attorney, Agent, or Firm*—Howard S. Reiter

[57] ABSTRACT

A durable, single action, variable displacement vane pump capable of undervane pumping, components thereof, and pressure balancing method. The pump comprises a cylindrical barstock rotor member having large diameter journal ends and central vane slots uniformly spaced therearound. The vane slots are elongate and have a central vane-supporting portion of maximum depth surrounded at each end by extension portions having depths which decrease axially to the surface of rotor member. The vaned rotor is rotatably supported within a unitary cam member having opposed faces and a circular bore therethrough forming a cam chamber having a continuous interior circular cam surface. The vane slot extensions in the rotor project outwardly beyond the cam chamber. An opposed pair of manifold bearings rotatably support the journal ends of the rotor and overlap the vane slot extensions to admit fluid to expanding vane bucket areas of the rotating vaned rotor and also into the vane slot extensions and undervane areas for pressure balancing purposes. Fluid passages and pressures within the pump are arranged to balance forces acting on various parts to reduce stress, improve sealing, and permit sharing of a fluid pressure source.

19 Claims, 8 Drawing Sheets

VARIABLE DISPLACEMENT VANE PUMP, COMPONENT PARTS AND METHOD

BACKGROUND OF THE INVENTION

1. Field of the Invention

The present invention relates to single acting, variable displacement fluid pressure vane pumps and motors, such as fuel and hydraulic control pumps and motors for aircraft use, component parts thereof and to a method for balancing fluid pressures.

Over the years, the standard of the commercial aviation gas turbine industry for main engine fuel pumps has been a single element, pressure-loaded, involute gear stage charged with a centrifugal boost stage. Such gear pumps are simple and extremely durable, although heavy and inefficient. However, such gear pumps are fixed displacement pumps which deliver uniform amounts of fluid, such as fuel, under all operating conditions. Certain operating conditions require different volumes of liquid, and it is desirable and/or necessary to vary the liquid supply, by means such as bypass systems which can cause overheating of the fuel or hydraulic fluid and which require heat transfer cooling components that add to the cost and the weight of the system.

2. State of the Art

Vane pumps and systems have been developed in order to overcome some of the deficiencies of gear pumps, and reference is made to the following U.S. Patents for their disclosures of several such pumps and systems: U.S. Pat. Nos. 4,247,263; 4,354,809; 4,529,361 and 4,711,619.

Vane pumps comprise a rotor element machined with slots supporting radially-movable vane elements, mounted within a cam member and manifold having fluid inlet and outlet ports in the cam surface through which the fluid is fed radially to the inlet areas or buckets of the rotor surface for compression and from the outlet areas or buckets of the rotor surface as pressurized fluid.

Vane pumps that are required to operate at high speeds and pressures preferably employ hydrostatically (pressure) balanced vanes for maintaining vane contact with the cam surface in seal arcs and for minimizing frictional wear. Such pumps may also include rounded vane tips to reduce vane-to-cam surface stresses. Examples of vane pumps having pressure-balanced vanes which are also adapted to provide undervane pumping, may be found in U.S. Pat. Nos. 3,711,227 and 4,354,809. The latter patent discloses a vane pump incorporating undervane pumping wherein the vanes are hydraulically balanced in not only the inlet and discharge areas but also in the seal arcs whereby the resultant pressure forces on a vane cannot displace it from engagement with a seal arc.

Variable displacement vane pumps are known which contain a swing cam element which is adjustable or pivotable, relative to the rotor element, in order to change the relative volumes of the inlet and outlet or discharge buckets and thereby vary the displacement capacity of the pump.

Among the disadvantages of known vane pumps are their lack of durability, susceptibility to wear, complexity of rotor and cam structures, necessity for end sealing plates to seal the ends of the rotor for the purpose of containing the pressurized fluid, and other essential elements which can provide vane pumps with variable metering properties not possessed by gear pumps but which detract from their durability or life span relative to the comparative durability and life spans of gear pumps. In conventional vane pumps the rotor is splined upon and driven by a central drive shaft having small diameter journal ends/which are not strong enough to withstand the opposed inlet and outlet hydraulic pressure forces generated during normal operation. This problem is overcome by forming such pumps as double-acting pumps having opposed inlet arcs and opposed outlet or discharge arcs which balance the forces exerted upon the journal ends, as disclosed by the prior art such as U.S. Pat. Nos. 4,354,809 and 4,529,361, for example.

SUMMARY OF THE INVENTION

The present invention relates to novel single acting, variable displacement vane pumps, and components thereof, which have the durability, ruggedness and simplicity of conventional gear pumps, and the versatility and variable metering properties of vane pumps, while incorporating novel features and properties not heretofore possessed by prior known pumps of either type.

The novel pump of the present invention comprises a durable, substantially uniform diameter rotor member which may be machined from barstock, similar in manner and appearance to the main pumping gear of a gear pump. The rotor has large diameter journal ends at each side of a central vane section which includes a plurality of axially-elongated radial vane slots having central deeper well areas, slidably engaging a mating vane element. The rotor slots are such that the vanes may be significantly greater in thickness than is permitted in pumps constructed in accordance with the prior art. Axial grooves or depressions may be included in the surface of the rotor between the vane slots. These depressions provide increased volume, to reduce sudden pressure build-up which can occur when the enclosed volume between the vanes is reduced as it is during the pumping process. This can create an effect similar to "water hammer" in a residential plumbing system. An adjustable, narrow cam member having a continuous circular inner cam surface eccentrically surrounds and encloses the central vane section, and the cam surface is engaged by the outer surfaces of the vane elements during operation of the pump. The cam housing pivots a pin to provide the means for adjusting the operating "displacement" of the pump. Pressure forces within the cam are directed, through the porting structures of the bearings, so that the cam loads are centrally (i.e., symmetrically) located relative to the pin, thereby reducing the force needed to actuate the cam and reducing the stresses on the pin. This arrangement permits forces to be distributed so that the pin is maintained in compression, thereby simplifying alignment and assembly of the cam to the pin. The pin includes a crowned alignment feature which assures that the cam and the bearings will always be in close proximity. The journal ends of the rotor member are rotatably supported within opposed durable manifold bearings, which may be made for example from barstock material, and which have manifold faces which contact opposite faces of the cam member and overlap the outer ends of the elongated radial vane slots. Each manifold bearing has interior inlet and discharge passages communicating with the cam—contacting manifold faces. The latter comprise an inlet arc segment opening to the inlet passages of the bearing, and a smaller discharge arc segment opening to the discharge passages of the bearing, separated from each other by opposed small sealing arc segments. Rotation of the journals of the vaned rotor member within the manifold bearings and of the central vane section within the cam member causes fluid such as liquid fuel to be admitted axially through the inlet arc segments of the bearings into the cam chamber and into expanding inlet bucket chambers between the vanes, and also through the inlet manifold passages and the vane slot extensions to under-vane chambers. Continued rotation of the rotor member through a sealing arc segment into a discharge arc segment changes the pressure acting upon the leading face of each vane from inlet pressure to increasing discharge pressure as the volume of each bucket chamber is gradually compressed at the discharge side or arc of the eccentric cam chamber. The pressurized fuel escapes into the discharge ports of each manifold bearing, through the discharge passages, and is channelled to its desired destination.

According to the present invention, the pressures acting upon the vanes are balanced so that the vanes are lightly loaded or "floated" throughout the operation of the present pumps. This reduces wear on the vanes, permits the use of thicker, more durable vanes and, most importantly, provides elasto-hydrodynamic lubrication of the interface of the vane tips and the continuous cam surface. Such balancing is made possible by venting the undervane slot areas to an intermediate fluid pressure in the seal arc segments of the manifold bearings whereby, as each vane is rotated from the low pressure inlet segment to the high pressure discharge segment, and vice versa, the pressure in the undervane slot areas is automatically regulated to an intermediate pressure at the seal arc segments, whereby the undervane and overvane pressures are balanced which prevents the vane elements from being either urged against the cam surface with excessive force or from losing contact with the cam surface. The intermediate pressure at the seal arc segments is derived from the servo piston pressure which is used to move the cam.

The regulation of the undervane pressure permits the use of thicker, more durable vanes by eliminating the unbalanced pressures which are found in the prior art. In the prior art, vanes are made thin to limit the loading of the vane against the cam, because relatively high discharge pressure produces the force that urges the vane tip against the cam, while relatively low inlet pressure acts to relieve the interface pressure between the tip and the cam. The small area of the thin vane allows tolerable loads at the vane tip but often requires dense brittle alloys and results in fragile vanes. Within the inlet arcs of the present invention the undervane areas are subjected to inlet pressure as are the overvane areas. Within the outlet arcs of the pump, the undervane areas are subjected to outlet pressure as are the overvane areas. Within the seal arcs of the pump, the undervane areas are subjected to a pressure that is midway between inlet and discharge pressure, to compensate for the overvane areas which are also subjected half to inlet and half to discharge. More importantly, the regulation of the undervane pressure and "floating" of the vanes causes the outer surfaces of the vanes to float over the continuous cam surface which is lubricated by the fluid being pumped, whereby metal-to-metal contact and wear are virtually eliminated. This overcomes the need for hard, brittle, wear-resistant, heavy metals, such as tungsten carbide, for the vanes and/or for the cam surface and permits the use of softer, more ductile, lightweight metals, particularly if the outer vane tips are radiused or rounded and a wear resistant coating, such as of titanium nitride, is applied to the outer rounded vane tip surfaces and to the cam surface.

The structural features of the journal bearing include a "hybrid" bearing pad which is supplied with discharge pressure from the pump. The discharge pressure provides a high load level bias which increases the load carrying capability of the bearing. The pad is configured with a single, axial pressure-fed groove, which provides lubricant and a pressure bias on the incoming rotor direction. The pad also includes a "U" shaped groove with the legs of the "U" positioned transverse to the axis of the journal bearing and the bottom of the "U" being located on the outgoing rotor direction. These legs and bottom of the "U" shaped groove are supplied with high pressure lubricating fluid to provide a desired pressure bias. The journal bearing structure further includes a larger diameter, eccentrically located flange on the face, which contacts the cam to assure that the bearings have sufficient load to maintain contact with the cam. The surface of the flange adjacent to the cam includes relief grooves to minimize the amount of face area which is subjected to discharge pressure induced outward load, from the cam. The surface of the flange most distant from the cam is loaded in its entirety with discharge pressure to assure that the net load acts against the cam. The eccentric favors increased area in the discharge pressure arc to assure that the loading is always against the cam. The top inner diameter of the bearing, for a distance around the sides slightly away from the hybrid pressure pad, contains labyrinth seal grooves for the purpose of limiting the amount of parasitic bearing flow.

The bearing seal-arc ports are located entirely above the horizontal centerline of the rotor with the bottom of these ports not being positioned below the centerline. In this manner, the ports will not be located in a region where the volume of the vane buckets is increasing, because expansion of the bucket volume in the seal area region tends to produce destructive cavitation. The ports, being above the centerline will permit only slight compression of the vane buckets, thereby avoiding the potential for cavitation.

The novel vane pumps of the present invention also provide substantial undervane pumping of the fluid from the undervane slot areas by piston action as the vanes are depressed into the slots at the discharge side of the cam chamber. Such undervane pumping can contribute up to 40% or more of the total fluid displacement.

DETAILED DESCRIPTION

Figure 1:
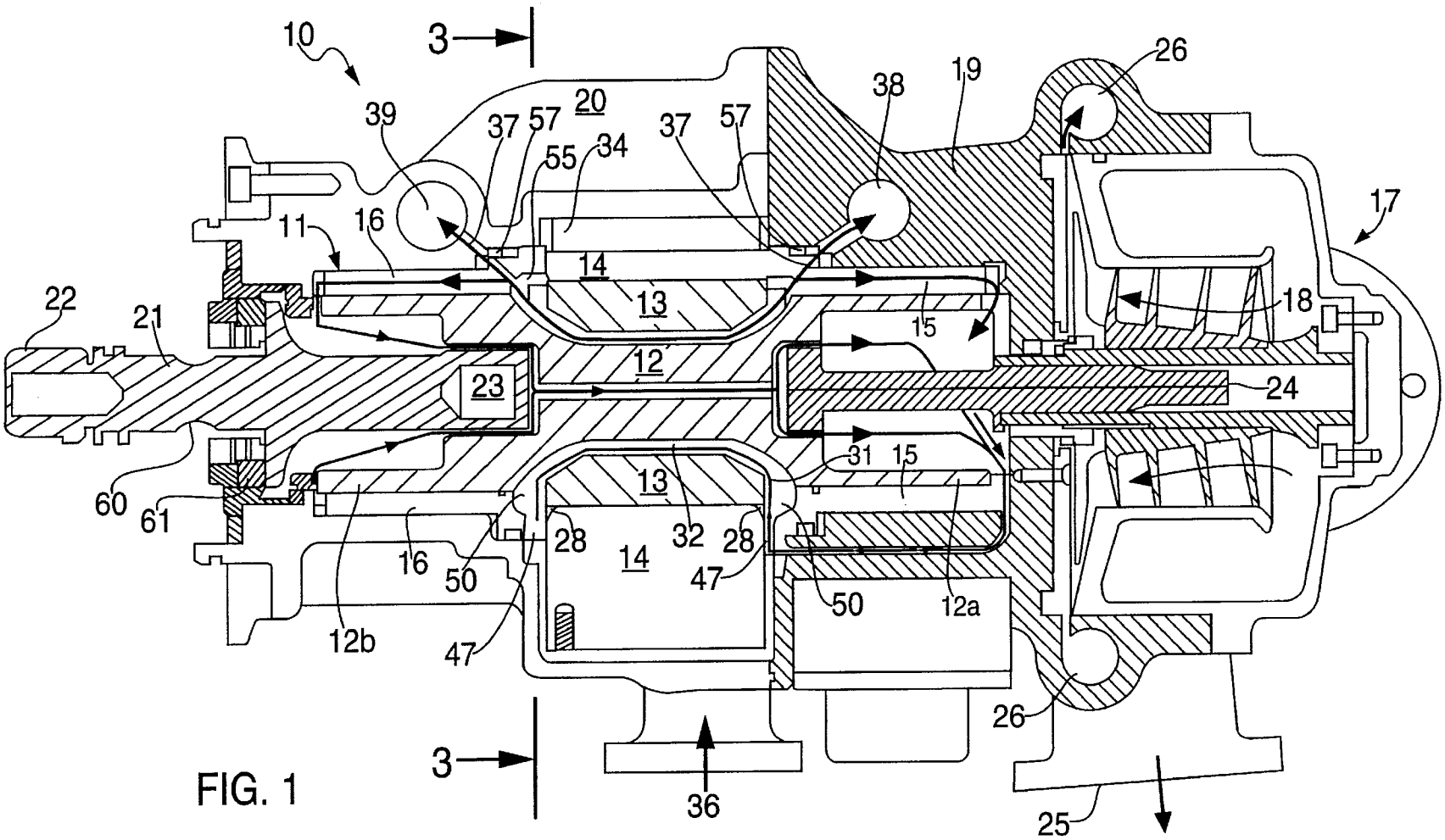
FIG. 1 is a schematic cross-sectional view of a fuel pump assembly according to one embodiment of the present invention, illustrating fluid flow paths therethrough.

Referring to FIG. 1, the fuel pump assembly 10 thereof comprises a variable displacement single acting vane pump 11 having a rugged barstock rotor member 12 having a plurality of vane elements 13 radially-supported within axially-elongated, concave vane slots 32 disposed around the central area of the rotor member 12. The outer tips of the vane elements 13 preferably are rounded to reduce their areas of contact with the interior continuous surface 14a (FIG. 3) of an adjustable cam member 14, and a pair of manifold bearing blocks or members 15 and 16 rotatably support the large diameter journal ends 12*a* and 12*b* of the rotor member 12 and provide axial sealing of the pressurized chamber. In this regard, the blocks 15 and 16 serve the function of the "side" or "end" plates of a conventional vane pump.

The vane pump 11 is fed with fluid from a centrifugal boost stage 17 comprising an axial inducer and radial impeller 18 and associated collector and diffuser means 26 mounted within a housing section 19 connected to a housing section 20 mountable on a main engine gearbox.

Power is extracted in conventional manner from an engine through a main drive shaft 21 which includes an oil-lubricated main drive spline 22, a fuel-lubricated internal drive spline 23, a shear section 60 and a main shaft seal 61. A second shaft 24 drives the boost stage 17 from a common spline with the main shaft 21.

Figure 2:
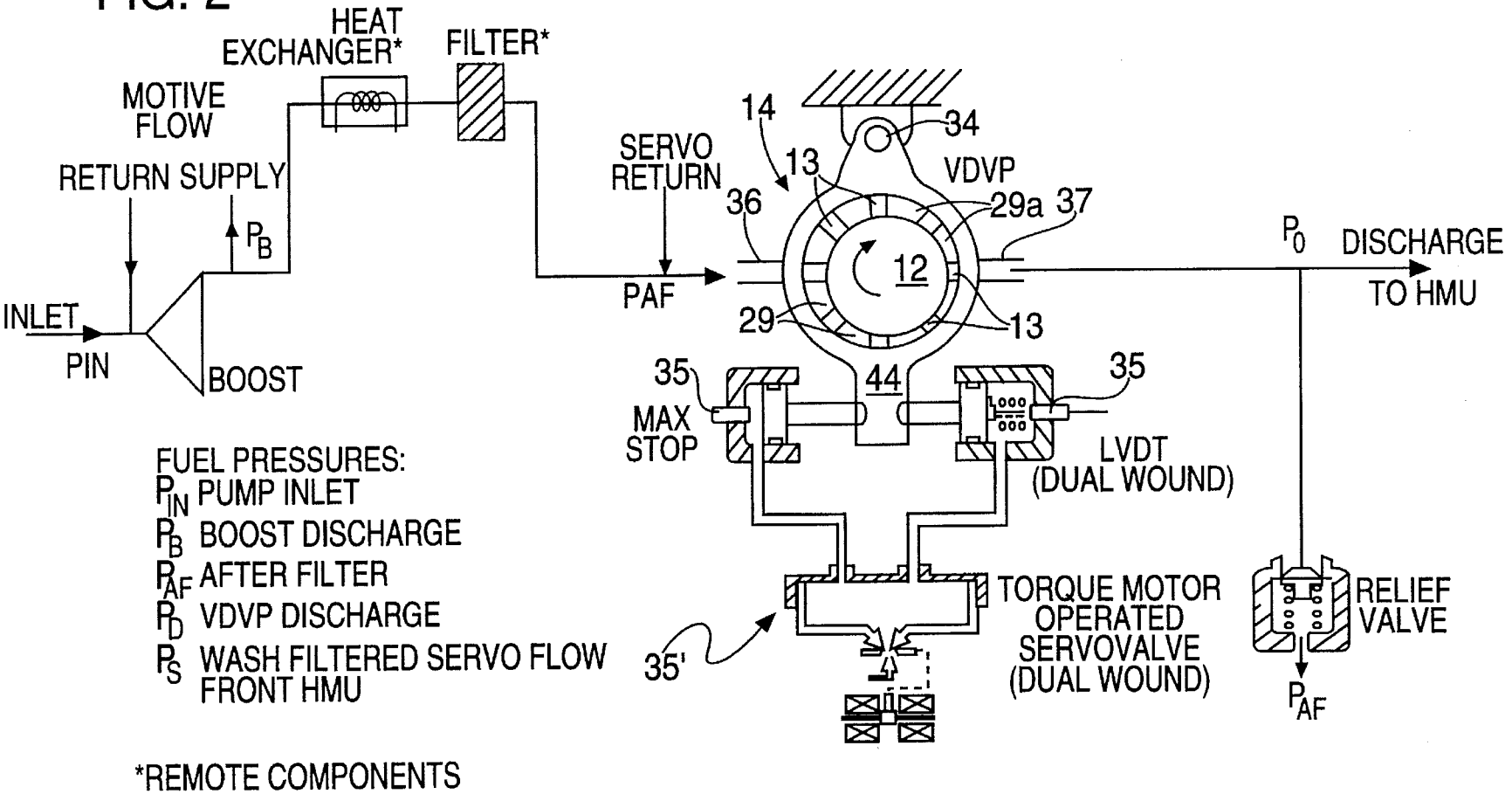
FIG. 2 is a schematic diagram of the fuel pumping system through the assembly of FIG. 1, including an adjustment system for the cam member to vary the fuel displacement volume.
Figure 3:
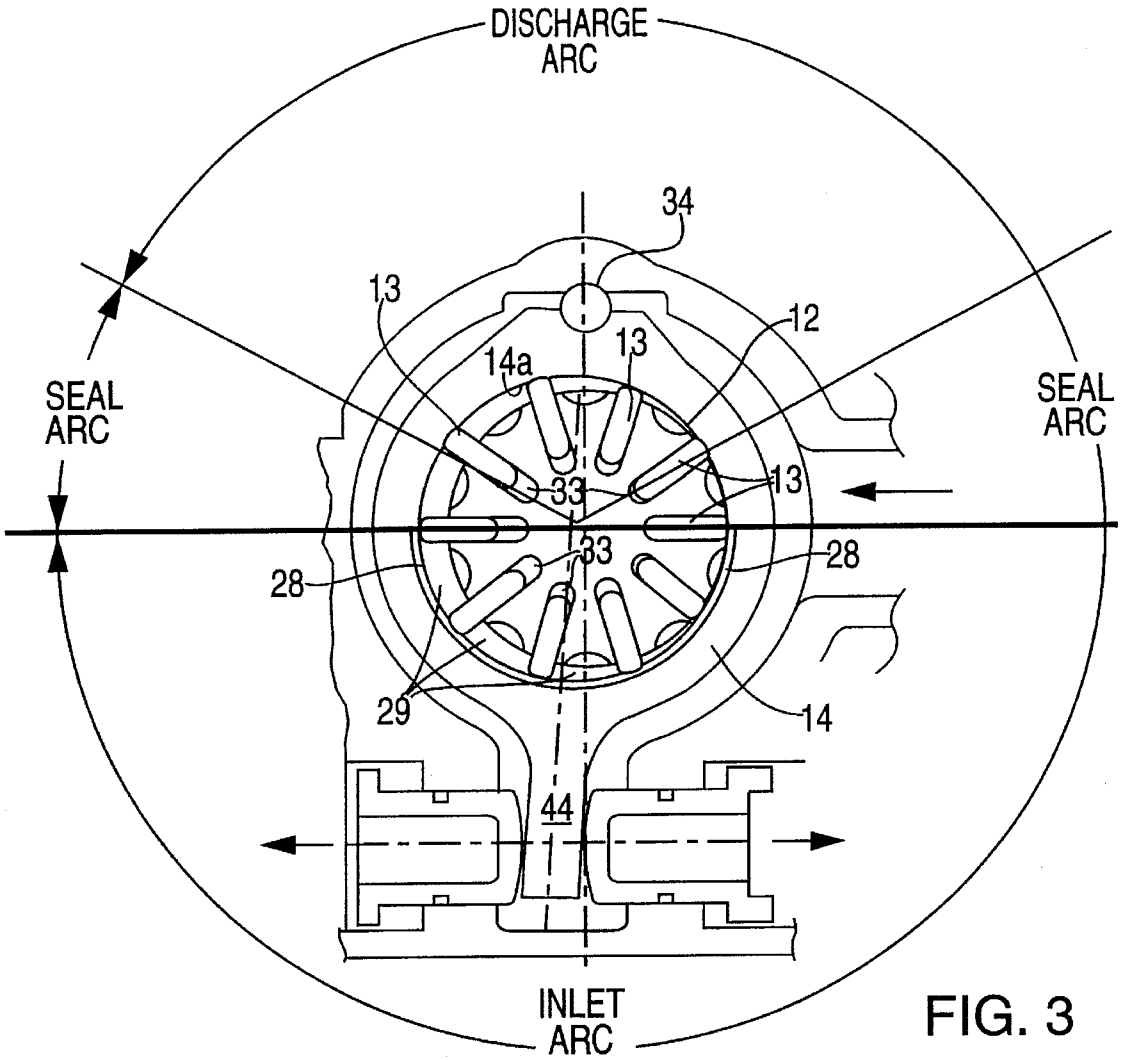
FIG. 3 is a schematic cross-sectional view of the single acting vane stage of FIG. 1 taken along the line 3—3 thereof.

The pump is mounted to the main engine gearbox, and ports are provided to passages through the housing section 19 for an outlet 25 from the boost stage 17 through diffuser means 26 to an external heat exchanger and filter (FIG. 2) and back into inlet passage 36 (FIG. 2) to the inlet arc section 27 of the manifold bearings 15 and 16 for axial introduction of the fuel, under inlet pressure, past the hemispherical bevels or undercut slots 28 on the opposed faces of the cam member 14 in the area of the inlet arc of the cam chamber and into the expanding fuel inlet buckets 29 formed between adjacent vane elements 13 within the inlet arc section of the cam member 14, as shown in FIG. 3.

Figure 4:
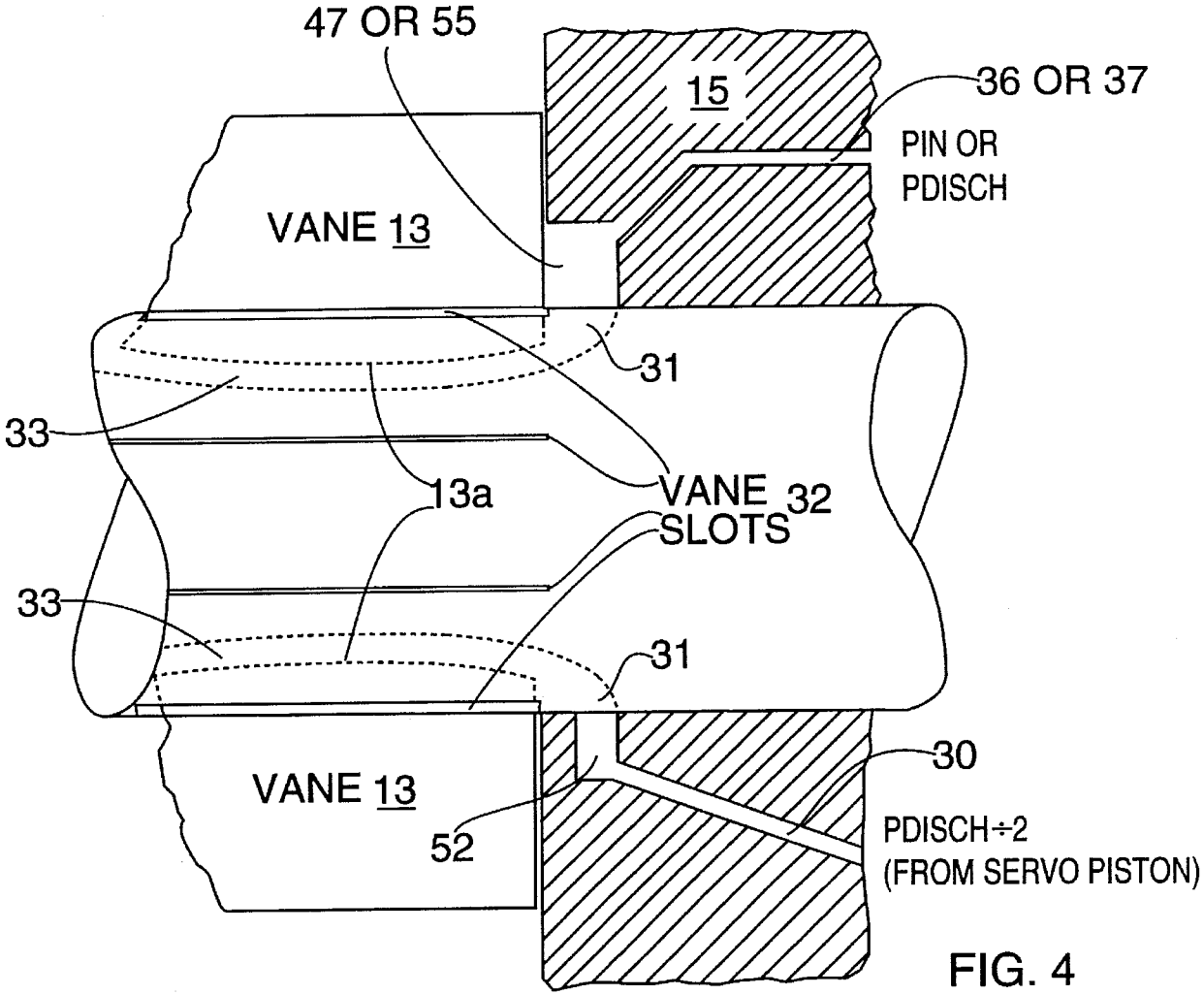
FIG. 4 is a simplified schematic depiction of the supply or discharge of fluid to or from the undervane slot areas in the areas of the inlet and discharge arcs respectfully, and of the porting of the undervane slot areas to an intermediate, balancing pressure in the areas of the seal arcs of the cam chamber.

Rotation of the rotor 12 and vanes 13 within the cam member 14 causes the inlet buckets 29 to move into a seal arc area where they become isolated from the inlet arc sections 27 of the manifold bearings 15 and 16 and begin to become compressed due to the non-concentric axial position of the rotor member 12 within the cam chamber, as shown in FIG. 3. Within the seal arc zones, which are transition zones between the lower-pressurized inlet pressure zone and the increased discharge pressure zone, each vane experiences a different overvane pressure on each side of it, which normally can cause intermediate overvane forces. However, as illustrated by FIG. 4, the present pumps provide special pressure relief passages 30 to a source of fluid at intermediate pressure in the seal arc areas whereby fuel is supplied at intermediate pressure through axial passages 30 in the manifold bearings 15 and 16 (FIG. 5) to the extremities 31 of the vane slots 32, beyond the vane elements 13, to produce an intermediate fluid pressure in the undervane slot areas 33 which balances the overvane fluid pressures and reduces the stresses or forces exerted by the vane tip surfaces against the continuous cam surface 14a in the area of the sealing arc zones. As can be seen from FIGS. 3 and 4, the undervane areas 33 are biased directly to inlet pressure, through slot extensions 31 and bearing ports and passages when the vane is in the inlet arc, and to discharge pressure when the vane is rotated to the discharge arc zone. In this manner, the vane loading in the inlet, seal, and discharge arc zones is held to very tolerable levels since the vane loads are achieved primarily through a combination of balanced pressure forces an low dynamic forces.

FIG. 2 is a simplified depiction of a cam member mechanism adjustable between minimum and maximum displacement flow positions. The cam 14 pivots on a pin 34 supported within housing section 20 at the top of the pump structure member. The pump is at maximum displacement when the cam 14 is positioned so that the vane buckets experience maximum contraction in the discharge arc zone. Likewise, minimum flow occurs when the cam 14 and the rotor 12 are almost concentric. Mechanical stops 35 are designed into a piston adjustment system 35' to limit cam displacement, generally, for the purpose of assuring that the cam will not contact the rotor surface (exceeds max displacement). These stops include shims for final production calibration. The piston adjustment system 35' is supplied with fluid at a predetermined pressure selected to be "intermediate" or "half-way" between the inlet and discharge pressures of the pump. This arrangement permits the use of a common source of fluid pressure (not shown) for both the adjustment system 35' and the axial relief pressure passages 30 and associated sealing arc ports 52 shown in FIG. 4 and described elsewhere herein.

As illustrated by FIGS. 1 and 2, the fuel exits the booster stage 17 of the pump through an external flanged outlet 25 and a collector/diffuser means 26 from the axial inducer/impeller 18 at the front of the boost stage 17. The axial inducer imparts sufficient pressure rise to the fluid to eliminate poor quality effects associated with line losses or fuel boiling and assures that the main impeller, downstream from the inducer, will be handling non-vaporous liquid. Angled slots in the impeller hub allow some of the flow to move from the front to the back side of the impeller. Hence fuel passes radially outward through the vaned passages on both sides of the impeller, subsequently to be collected and diffused. As shown in FIG. 2, the fuel exits the booster stage 17 through outlet 25 to pass through the external engine heat exchanger and filter, subsequently, to return, via an inlet passage 36 in housing section 20, to the main vane stage. Fuel enters around the main vane stage cam 14 in the inlet arc zone 27 and is admitted, axially, to the expanding inlet vane buckets 29 through an undercut slot 28 on each cam face from face recesses in each of the bearings 15 and 16 and on both sides of the cam 14. Each vane bucket 29 then carries the fuel circumferentially into the discharge arc where contracting discharge bucket 29*a* squeeze the fuel axially outward into discharge ports 55 (FIG. 7) cut into the faces of the bearings 15 and 16 in the discharge arc zone, subsequently to be discharged to the engine through cored passages 38 and 39 in the housing sections 19 and 20. FIG. 1 provides a depiction of the flow path through the system.

Certain prior art vane pumps were designed to perform in the absence of a filter and therefor intimate working parts, including cams, vanes and sideplates, were fabricated from tungsten carbide, a very tough, dense, brittle material. The high density of the vanes resulted in high centrifugal loading which, when combined with the substantial pressure loads under the vanes in the inlet and sealing arcs, demanded that the vanes be very narrow in order to minimize vane loading/wear at the interface with the cam. Through the incorporation of filtered fuel as the means for contamination resistance, and the use of pressure balancing as the means for moderating the forces acting on the vanes, a lower density, more ductile high vanadium-content tool steel alloy material is used according to the present invention, thereby assuring a far less fragile pumping vane and cam.

The novel design of the present pumps enables the use of thicker vanes which obviously have lower bending stress and greater column stiffness. A less obvious but very important corollary to the effect of thicker vanes is that the vane tip radius can be much greater (a factor of five), thereby permitting configuration of the vane tip as a continuous, smooth surface for the enhancement of vane tip lubrication at the interface with the continuous cam surface 14*a*.

Figure 5:
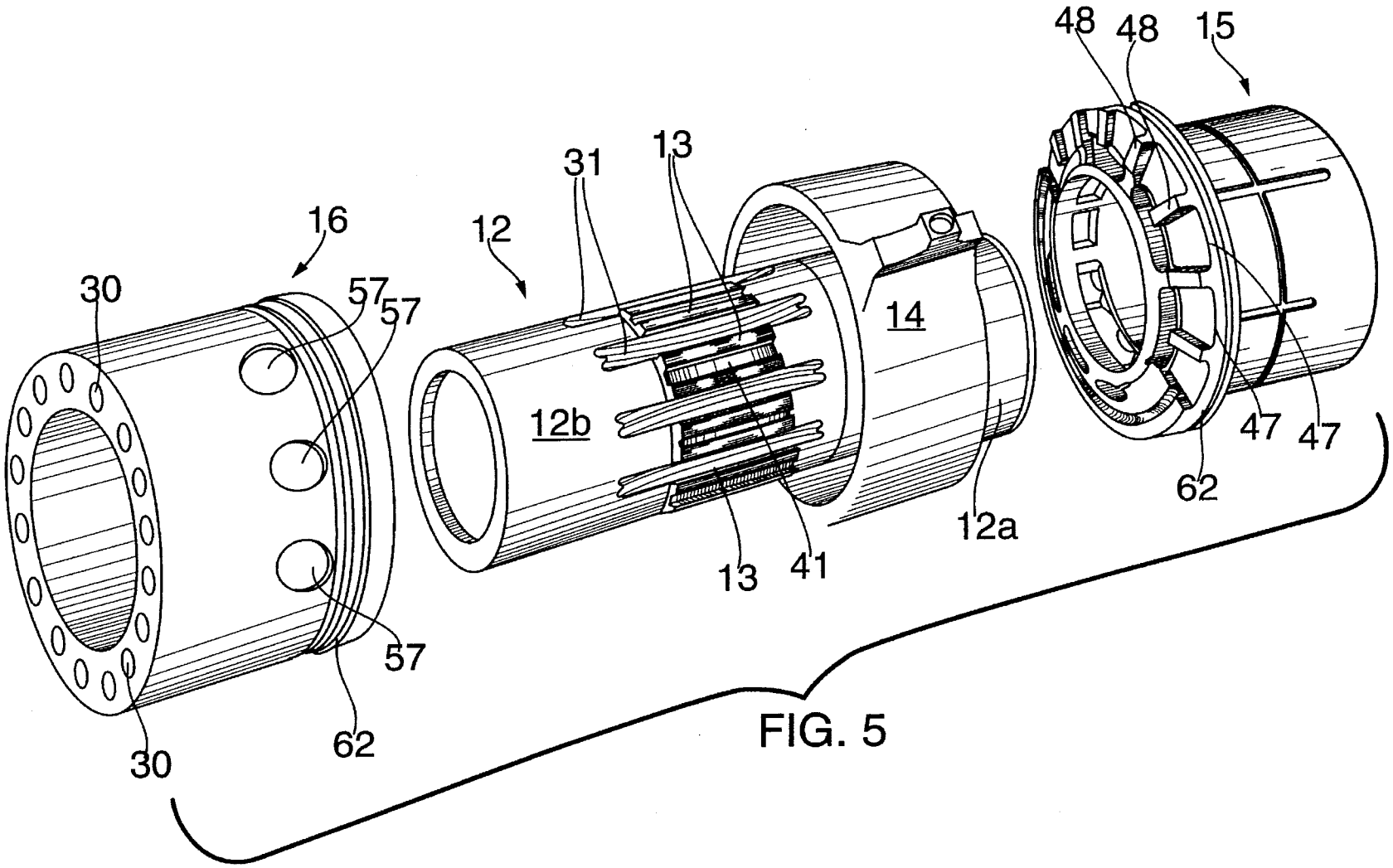
FIG. 5 is a perspective view of a single acting vane stage comprising a substantially uniform-diameter rotor member, containing vanes, a cam member and manifold bearing members according to the present invention, the members being shown in disassembled configuration for purposes of illustration.
Figure 6:
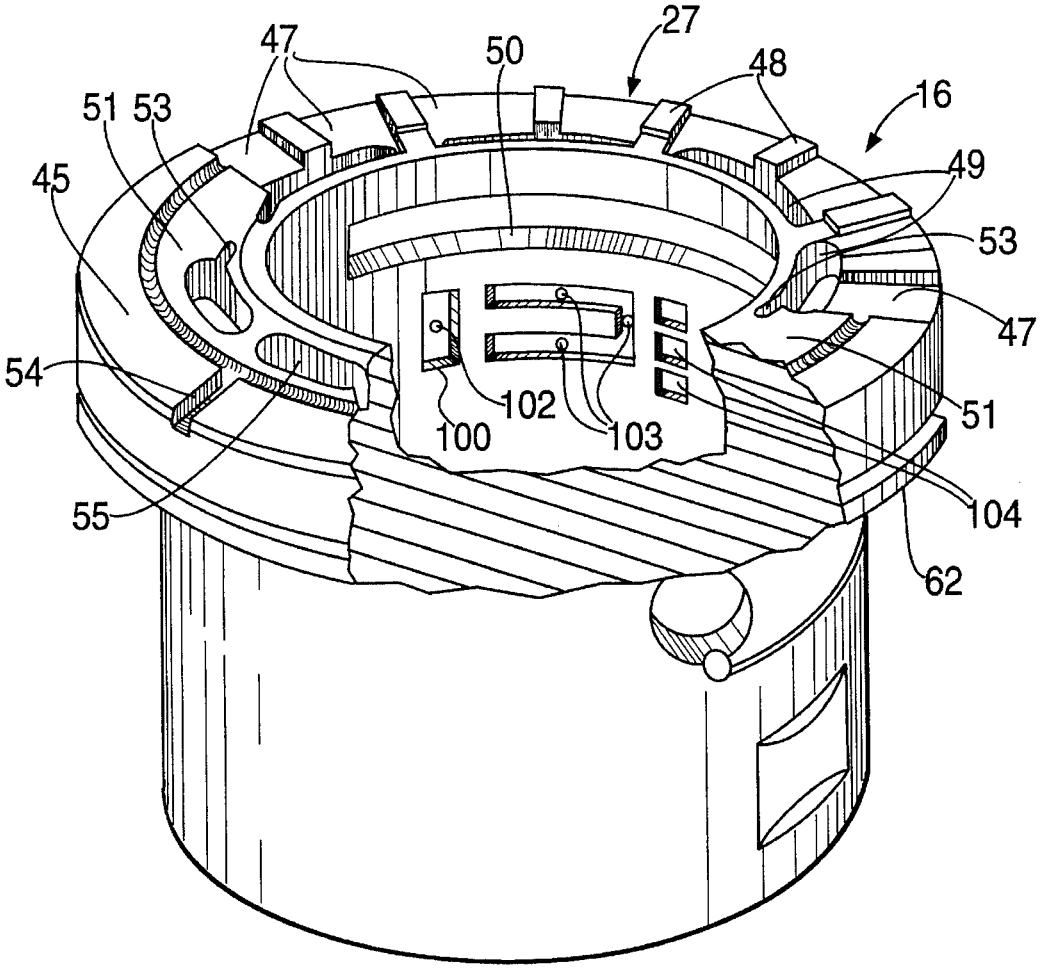
FIG. 6 is a partially cut-away perspective view of the pressure pad of the manifold bearing members of FIG. 4 viewed from one end thereof.
Figure 7:
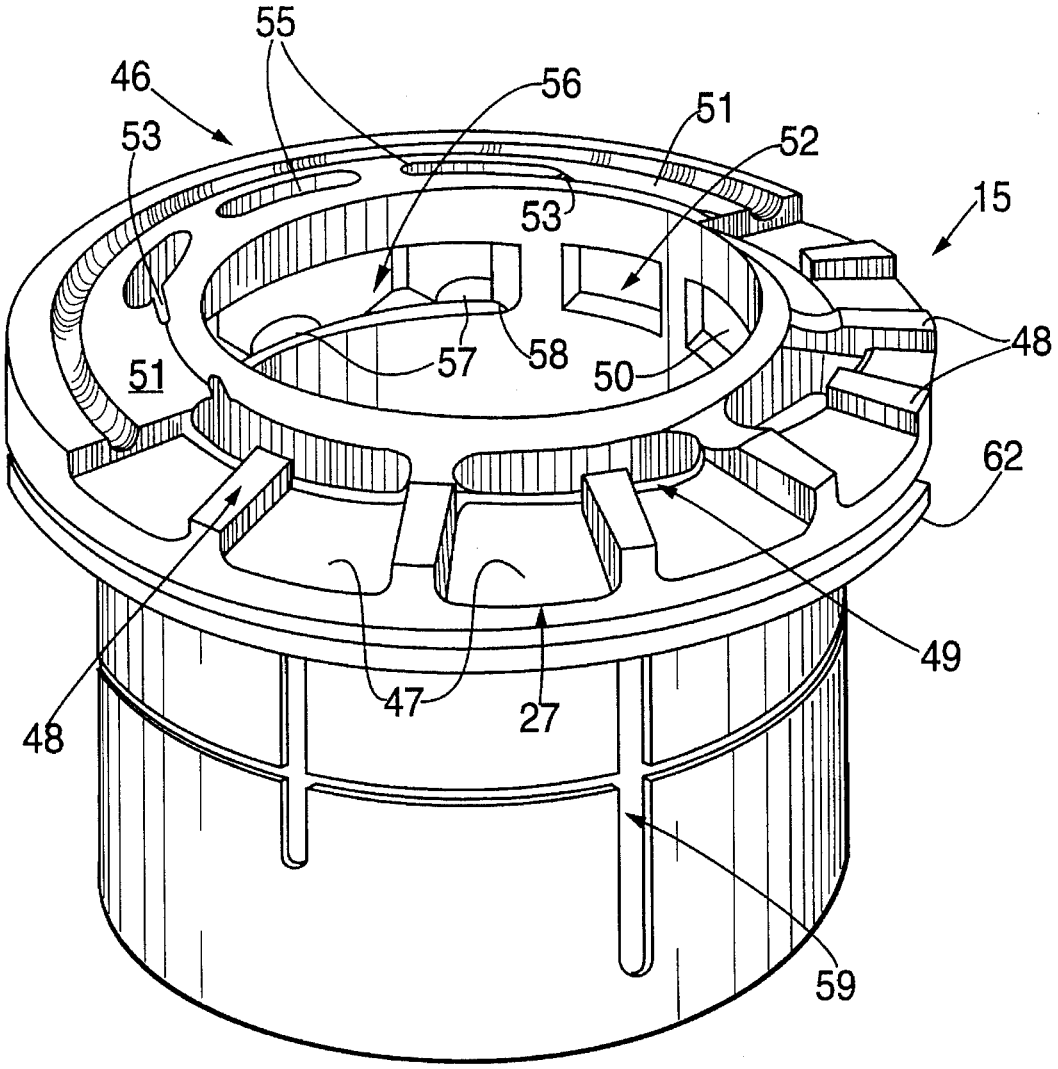
FIG. 7 is a perspective view of the manifold bearing members of FIG. 6, viewed from the opposite end thereof.

In addition to balancing the undervane and overvane loads on the vane elements 13, the undervane access and capacity through the downwardly-tapered vane slot extensions 31 increases the volumetric capacity of the pump by enabling the introduction and discharge of undervane fluids to and from undervane areas 33. As the vane passes through the inlet arc, the cavity 33 under the vane 13 is filled with fuel as the vane expands out of the vane slot 32. As the vane passes through the discharge arc, the downward movement of each vane 13 into its slot 32 forces that fluid out of each undervane cavity 33, resulting in a pumping action which greatly increases the capacity of the pump. The present pumps have thick vanes and can extract almost 40% of capacity from undervane pumping. The vane elements 13 fit snugly within the vane slots 32 and function like pistons as they are depressed into the arcuate slots 32 during movement of the rotor through the discharge arc, whereby fluid is expelled axially from the undervane areas 33 outwardly in both directions through the slot extensions 31, discharge ports 37 and cored passages 38 and 39. The bulk of the pressurized discharge fluid or fuel is expelled from the bucket areas 29*a*, between vane elements 13, but the undervane volume from cavities 33 can equal as much as about 40% of the total discharge volume. Referring to FIGS. 5 to 8 of the present drawings, these illustrate in greater detail the rugged, robust barstock rotor member 12 (FIGS. 5 and 8), vane elements 13 (FIG. 5), cam member 14 (FIG. 5) and manifold bearings 15 and 16 (FIGS. 5 to 7).

The rotor member 12 has an appearance and shape similar to a conventional heavyweight gear shaft in that it has a substantially uniform thick diameter throughout, and a central vane area 40 comprising optional spaced radial teeth 41 which provide additional support for the vane elements 13 in areas above the vane slots 32 cut into the rotor cylinder. Between every other pair of said teeth 41 a contoured arcuate vane slot 32 is machined radially into the rotor to receive a relatively thick vane element 13 having an axial length similar to the length of the teeth 41 and of the central vane area 40 so that each vane 13 occupies only the central, deep area of each arcuate or contoured slot 32, and the outwardly-tapered extremities 31 of each slot 32 are open beneath the adjacent undersurface areas of the manifold bearings 15 and 16. Moreover the contoured seat areas 42 of each slot 32 are raised stop areas between deeper well or floor areas 43 to provide undervane areas or cavities 33 even if the contoured undersurface 13*a* of the vanes 13 (shown in FIG. 4) is depressed into contact with the raised seat recesses 42.

As can be noted, the undervane regions and cavities 33 are open at slot areas 31 directly to inlet pressure when each vane element 13 is in the inlet arc, and directly to discharge pressure when each vane element 13 is located in the discharge arc region. In this manner, the vane loading in the inlet and seal arcs is held to very tolerable levels since the vane loads are achieved primarily through dynamic forces. Within the seal arcs, the transition region between inlet and discharge (and vice-versa), each vane 13 normally would experience a different pressure on each side of it, resulting in intermediate overvane forces which must be counteracted. However, sealing arc ports 52 are provided in the inner diameter walls of the bearings 15 and 16, between the inlet and discharge arc zones, which communicate through axial relief pressure passages 30 in the bearing walls with a fluid source at an intermediate pressure level, approximately halfway between inlet and discharge pressures, as shown by FIG. 4.

Prior-known vane pumps utilized discharge pressure under the vanes to assure that the vanes properly tracked the cam surface in all areas of operation. That approach was to assure that the vane trajectory followed the cam contour. The resulting high forces, especially in the inlet arc, yielded a propensity for wear at the tip of the vanes. The present invention utilizes the resident pressure in the inlet and discharge arc areas or zones and a regulated intermediate level of pressure in the sealing arc areas or zones to provide a balancing pressure under the vanes. This assures that each vane element 13 will always track the continuous cam surface 14*a* on an elasto-hydrodynamic film, thereby assuring long life at the vane tip wearing surfaces. Vane speeds (pump RPM) are held at levels which provide sufficient residence time to assure that the vane trajectory will properly track the cam surface.

In the inlet and discharge arc, shown in FIG. 3, the overvane and undervane pressures are equal. In the seal arc where the overvane sees inlet pressure on ½ of its tip and discharge pressure on the other ½ half of its tip, the undervane cavity 33 is ported to a servo piston chamber which is at approximately ½ discharge pressure. Thus the vanes 13 are pressure balanced or floated throughout the entire revolution, thereby reducing centrifugal stress forces and wear at the interface between the rounded vane element surfaces and the continuous surface 14*a* of each cam element 14, enabling the use of thicker, stronger vane elements and producing elasto-hydrodynamic lubrication at said interface.

The rugged, one-piece cam element 14 of FIGS. 2, 3 and 5 is machined from a solid ingot, such as of high vanadium-content tool steel alloy. The cam element is banjo-shaped, having a circular axial bore or cam chamber in the middle for containment of the central vane area 40 of the vaned rotor section, a pivot shaft or pin 34 at the top which provides the fulcrum for the variability feature, and an extension 44 at the bottom which provides a lever for exerting adjustment force to vary the displacement. A generous chamfer bevel or slot 28 exists within the inlet arc on both cam faces to facilitate the introduction of the fuel into the expanding vane buckets 29.

The pivot pin or shaft 34 is a simple cylinder, made of any suitable high strength alloy such as high vanadium content tool steel alloy coated with titanium nitride, which engages a cam pivot notch and a seat in the housing section 20.

An important feature of the present cam elements 14 is the continuous smooth cam surface 14*a*, shown in FIG. 3, which is made possible by the axial fuel delivery and discharge means of the present pump assemblies. Prior-known variable displacement pumps contain interruptions in the cam surface, such as radial inlet and discharge ports or a variable displacement parting line between cam sections which, however refined in edge treatment, are bound to cause irregularities in the operation of the vanes. In the case of two-piece vanes, necessitated by brittle material, special precautions had to be taken to assure that the vanes do not tilt into the openings, thereby causing destructive wear. The present pumps utilize an unbroken continuous cam surface 14*a* which provides uniform support of the vane elements 13 throughout their travel. This, coupled with the balancing of the undervane and overvane pressures and the elastohydrodynamic lubrication of the vane/cam interface, substantially reduces wear and increases the lifetime of the present pumps and components.

Figure 8:
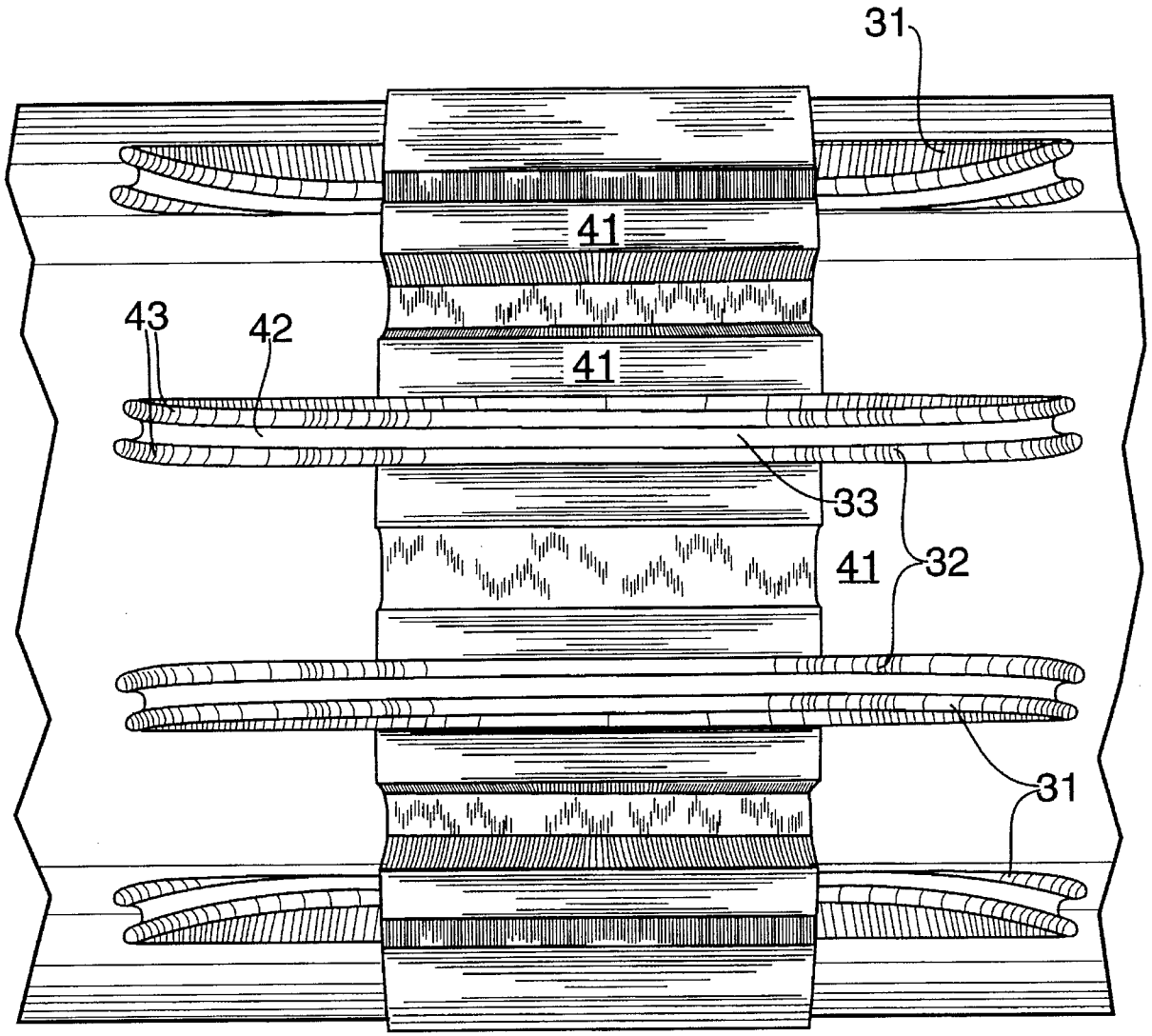
FIG. 8 is an enlarged perspective view of the central slotted area of the rotor member of FIG. 5, with the vane elements removed to illustrate the novel configuration of the vane slots therein.

The present rotors 12, shown in FIGS. 5 and 8, differ substantially from prior known vane rotors since the latter have straight line, flat-bottom vane slots, parallel to the rotor axis, extending through sideplates, and require sideplates with undervane communication grooves and other features which necessitate the use of small-diameter journal shafts. Such shafts cannot withstand the opposed inlet and outlet forces of a single action pump and necessitate the incorporation of two opposed inlet and outlet stages for double action balance. The journal ends 12*a* and 12*b* of the present rotors are hefty, large diameter journals. Furthermore, the massive characteristic of the rotor 12 eliminates the structural weakness associated with vane slots being too close to the internal drive spline in prior known pumps. The strength of the rotor element 12 is complimented by the hefty nature of the identical manifold bearings 15 and 16 which rotatably receive and support the journal ends 12*a* and 12*b* of the rotor 12.

As shown most clearly in FIGS. 6 and 7, the manifold bearings 15 and 16, are unitary machined elements incorporating the functions of a journal bearing, a face bearing and a sideplate. The bearings are designed for rugged, infinite life operation. The bearing material can be ductile leaded bronze alloy or a suitable equivalent. The bearing faces and inner diameter surfaces are treated with indium plating and dry film lubricants.

Each bearing face, which contacts a face of the cam member 14, comprises an inlet arc section 27, comprising about one-half of each face, an outlet or discharge arc section 45, comprising a wide angle of less than 180 degrees and transition seal arc areas between the inlet arc and discharge arc section, comprising angles such that the sum of the discharge arc and the two seal arcs is 180 degrees.

Referring to FIGS. 6 and 7, the bearing faces are machined or sculpted to provide an inlet half section 27 and a seal/discharge half section 46. The inlet half section 27, or 180° section, comprises radial face inlet recesses 47, cut between stand-off radial face portions 48, providing inlet recesses to inlet ports 49 opening into a arcuate common chamber 50 beneath the face of the inlet arc surface 27, which opens to the inner-diameter surface of the bearings 15 and 16. The stand-off radial face portions 48 of each bearing contact a face of the cam member 14, as does the face of the seal/discharge half 46, to assure uniform bearing strength for the loads associated with interaction with the cam member 14.

Each bearing 15 and 16 has a face portion of increased diameter, compared to the remainder of the bearing, thereby providing a flange or shoulder 62 against which a spring-loading means can be biased to pressure-load the bearing faces against the opposed cam faces with sufficient force to prevent leakage of the pressurized fuel from the cam chamber.

As can be seen from the fuel flow illustration in FIG. 1, the outer extremities or extensions 31 of the vane slots 32 extend beyond the cam member 14, at each side thereof, and underlie the inner diameter surface of a bearing 15 or 16 so as to open the undervane areas 33 of the vane slots 32 to the inlet chamber 50 at the inlet side of the bearings 15 and 16. Also, the recesses 47 of each bearing face communicate with an undercut slot 28 on an opposed face of the cam member 14, and with an inlet passage 36, to admit inlet fuel into the inlet buckets 29 or overvane areas, as illustrated by FIG. 4.

Rotation of the rotor-vane pump moves each expanding inlet bucket 29 into axial opposition to the seal/discharge half 46 of the bearing faces where the overvane bucket areas move past the open inlet recesses 47 and over the closed seal arc face 51 which isolates the bucket areas from the inlet conduits but opens the undervane areas to an intermediate pressure fluid supply through the seal arc port 52 which communicates with the vane slot extensions 31 at the inside surface of each bearing 15 and 16. Ports 52 open to isolated axial passages 30 (FIGS. 4 and 5) within the bearings which communicate with a source of fluid at regulated pressure, intermediate the inlet and discharge pressures. However, eyelet cuts 53 are placed in the sealing arc face 51 to assure that the vane buckets within the sealing arcs cannot undergo unvented compression. This assures that the undervane areas 33 of the vane slots 32 are held within pressure limits during the period of time that the vane buckets pass through the intermediate regions between the inlet pressure and the discharge pressure arcs.

Continued movement of the vane buckets over the face 54 of the discharge arc section 45, shown between broken lines in FIG. 7, opens the compressed buckets 29*a* to discharge ports 55 in face 54 as the buckets undergo compression due to the eccentric, non-concentric axial position of the cam member relative to the rotor/vane pump enclosed within the cam member 14, as illustrated by FIG. 3. The discharge ports 55 are inlets to a common internal discharge chamber 56 having discharge outlet ports 57 in the outer diameter wall of the bearings 15 and 16 and having a common vane slot discharge port 58 in the inner diameter wall of the bearings to admit undervane pumping fluid discharge from the undervane areas 33 through the vane slot extensions 31, as shown in FIGS. 1, 5 and 7. As illustrated by FIGS. 1 and 7, the outer diameter discharge outlet ports 57 open radially outwardly to discharge passages 37 and conduits 38 and 39 in the housing to deliver the fluid or fuel at elevated discharge pressures to an engine, hydraulic system or other desired destination. The discharge ports 55 in face 54 are open axially to the contracting vane buckets 29*a* during their compression to admit the vane bucket volumes of the pressurized fluid, while the inner diameter port 58 is open to the vane slot extensions 31 to receive the fluid which is pumped from the undervane areas 33 (FIG. 3). This may represent up to about 40% of the total amount of fluid being pumped. Fluid is pumped from the undervane areas in this manner as the vane elements 13 are depressed into their slots 32 to compress and displace the undervane fluid axially in both directions from the undervane areas 33, through the slot extensions 31, and into the inner diameter bearing ports 58 to chamber 56 and outer diameter outlet ports 57.

In summary, fuel enters the present pump assemblies 10 through an external inlet flange and a cored passage which leads to the axial inducer 18 at the front of the boost stage 17. The axial inducer imparts sufficient pressure rise to the fluid to eliminate poor quality effects associated with line losses or fuel boiling and assures that the main impeller, downstream from the inducer, will be handling non-vaporous liquid. Angled slots in the impeller hub allow some of the flow to move from the front to the back side of the impeller. Hence, fuel passes radially outward through the vaned passages 26 on both sides of the impeller, subsequently to be collected and diffused. The fuel leaves the pumping system through outlet 25 to pass through the engine heat exchanger and filter, subsequently to return, via a cored passage 36, to the main vane stage. Fuel enters a plenum around the main vane stage cam and is admitted, axially, to the expanding inlet vane buckets 29 through an undercut slot 28 on both side faces of the cam 14. Each vane bucket 29 then carries the fuel circumferentially into the discharge arc where the contracting bucket 29*a* squeezes the fuel axially outward into ports 55 cut into the face of the manifold bearings 15 and 16. The overvane bucket fuel is then discharged through chamber 56 and the bearing ports 57 into a port 37 between the bearing 15, 16 and the housing 19, 20 subsequently to be discharged to the engine through cored passages 38, 39 in the housing. The undervane fuel is discharged through the vane slot extensions 31 into the discharge chamber 56 through the inner diameter port 58 to contribute up to about 40% of the total fuel pumped through the outer diameter ports 57.

The manifold bearings 15 and 16 receive lubricant and cooling flow through two sources. The high pressure discharge arc 45 of the vane pump provides a source of pressure to force fuel axially through the diametral clearance between rotor journals 12*a* and 12*b* and bearings 15 and 16. This flow is managed through careful clearance control in addition to a set of labyrinth seals or grooves 59 (FIG. 7) cut into the outer surfaces of the bearing shells in the unloaded zone. Additional lubricant is admitted to bearing pressure pads in the bearing load zone at the inner diameter bearing surface from the high pressure plenum between the bearing and the housing.

All of this bearing drain flow is gathered at the ends of the bearings furthest from the cam member 14. The drain drawing flow from the bearing at the drive end of the pump is directed through the main drive spline 22 to provide lubrication in that critical area. The drain flow for both bearings 15 and 16 is thus collected in one location at the boost end of the pump where it is returned, via cored passages 36 to the vane stage inlet. Some additional lubricant is permitted to flow from the boost end gathering point through the splines of the drive shaft 24 and ultimately drains to the area between the axial inducer and the impeller, this location chosen to assure that the hot drain flow cannot corrupt the capabilities of the boost stage 17.

With reference to FIGS. 6 and 7, the journal bearings 15 and 16 are a "hybrid" configuration incorporating the principles of both hydrodynamic and hydrostatic lubrication. A pressure-fed lubrication groove 59 is provided to feed the high pressure lubricant to the bearing. A pressure pad is formed from an axially Oriented groove 100 and a "U" shaped groove 101. The axial groove 100 is supplied with high pressure lubricant through a feed hole 102 from the external groove 59 and its purpose is to provide spillover lubrication into the pad as well as provide a high reference pressure for increased load carrying capability. The "U" shaped groove 101 is supplied with high pressure lubricant through feed holes 103 and its purpose is to provide the high pressure reference around the remainder of the pad for increased load carrying capability. The grooves are not connected in order to assure that the spillover lubrication must occur and that the lubricant cannot be shunted through the U-groove away from the load zone. This hybrid configuration permits a lubricant film thickness which is substantially greater than that which could be achieved, under the same unit bearing loads, with a hydrodynamic configuration but which does not incorporate the high parasitic leakages which would occur with a pure hydrostatic bearing. The bearing drain pressure is referenced to boost stage discharge and thus assures sufficient ambient pressure to prevent bearing cavitation.

The bearings 15 and 16 are carefully suspended to assure that they will retain intimate proximity with the cam face and will remain stable throughout the operating range for the pump's entire operating life. One of the bearing blocks such as 15 is "grounded" within the housing and becomes the reference for the entire pump assembly. The cam 14 and the remaining bearing 16 are assembled relative to the bearing block 15. Springs load against the end of the bearing block 16 which is furthest away from the cam 14 to assure intimate proximity of the three parts during initial start up. As fluid pressure is developed it applies force against the bearing flange 62 to increase the load of the bearing against the cam. A relief groove 101 allows low inlet pressure to bear against a substantial portion of the face of the bearing 16 which is adjacent to the cam 14, to help assure that pressure loads will tend to clamp the bearings 15 and 16 to the cam 14.

One end of the main drive shaft 21 incorporates a male spline 22 which engages with the engine gear box and is lubricated with engine gear box oil. The opposite end of the shaft also incorporates a male spline 23 which engages a matching female spline in the main pump rotor 12. This spline is lubricated with fuel which is flushed through it as part of the internal flow schematic illustrated in FIG. 1. The boost stage drive shaft 24 engages the same female spline in the main pump rotor 12 while the opposite end of the boost shaft is splined to engage the boost stage inducer section 18.

All of the components of the present pumps are enclosed in cast aluminum housing sections 19 and 20. The main vane stage is grounded through the bearings 15 and 16 against a housing structure which is designed to be very rigid yet light in weight, thereby assuring that none of the components of the vane pump cluster will become misaligned during high pressure operation. The housing material is selected for this application to be well suited for the fuel temperature range expected with a well established fatigue stress background.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A durable, single action, variable displacement vane pump capable of undervane pumping comprising:

(a) a cylindrical rotor member having journal ends and a central vane section comprising a plurality of radial vane slots uniformly spaced around the central circumference thereof, said vane slots being elongate in the axial direction and each having a central vane-supporting portion surrounded at each end by slot extension portions;

(b) a plurality of vane elements, each slidably-engaged within the central vane-supporting portion of a said vane slot for radial movement therewithin;

(c) a unitary cam member having opposed faces and a circular bore therethrough forming a cam chamber having a continuous interior cam surface, the central vane section of said rotor member being supported axially and non-concentrically within said cam chamber so that the outer tip surfaces of all of the vane elements make continuous contact with said continuous interior cam surface during rotation of said rotor member, and said vane slot extensions project axially-outwardly beyond the faces of said cam member;

(d) an opposed pair of manifold bearings rotatably supporting the journal ends of said rotor member and overlying said vane slot extensions, each said bearing having a bearing face surface which contacts a face surface of said cam member and encloses the central vane-supporting portion of said rotor member within said cam chamber, each manifold bearing comprising an inlet arc segment containing means for admitting fluid to expanding vane bucket areas of the rotating vaned rotor, and means for admitting fluid into said vane slot extensions and undervane areas, and a discharge arc segment containing means for discharging pressurized fluid from contracting vane bucket areas of the rotating vaned rotor and from undervane areas as the vanes are depressed into the vane slots during rotation through the discharge arc, said cam member being adjustable relative to said vaned rotor to vary the extent of eccentricity therebetween for varying the displacement capacity of said vane pump.

2. A vane pump according to claim 1 in which each face of the cam member contains inlet means adjacent an arcuate segment of the cam bore, corresponding to the inlet arc of the bearing faces, to admit inlet fluid to the expanding vane bucket areas.

3. A vane pump according to claim 1 in which at least one of said manifold bearings further includes:

an axial pressure groove having an inlet for pressure-fed lubricant providing pressure bias for the rotor in the incoming rotor direction; and a cooperatively positioned substantially U-shaped lubricating groove independent of said axial pressure groove and having an axial base portion and transversely positioned leg portions each having an inlet for pressure-fed lubricant; the said base portion being located in the outgoing rotor direction relative to said axial pressure groove.

4. A vane pump according to claim 1 in which said rotor member comprises a cylindrical barstock of relatively-uniform diameter having journal ends of said diameter.

5. A vane pumping according to claim 1 in which said rotor member further includes depressions in the rotor surface between said radial vane slots which provide additional fluid volume to reduce the effects of rapid pressure build-up during operation of the pump.

6. A vane pump according to claim 1 in which said central vane section comprises a plurality of radially-extending teeth, adjacent pairs of said teeth being formed as wall extensions of said vane slots to further support said vane elements during their radial movement within the vane slots.

7. A vane pump according to claim 1 in which each said vane slot has an arcuate floor which tapers uniformly from the central maximum depth portion upwardly and outwardly to said extension portions.

8. A vane pump according to claim 1 in which each vane slot has a contoured floor and each vane element has an undersurface which is contoured to correspond with the contour of the floor of the vane slot.

9. A vane pump according to claim 1 in which each said vane slot has an arcuate floor and the undervane face of each said vane is arcuate.

10. A vane pump according to claim 1 in which each bearing face also contains seal arc segments at transition areas between the inlet arc and the discharge arc segments, said seal arc segments having a sealing face for isolating the vane bucket areas from inlet and discharge pressures, and an inner diameter passage for opening the vane slot extensions and undervane areas to a source of fluid at a regulated pressure intermediate said inlet and discharge pressures.

11. A vane pump according to claim 10 in which each bearing face comprises an inlet arc of about 180°, a seal arc of about 36°, a discharge arc of about 108° and a second seal arc of about 36°.

12. A vane pump according to claim 1 in which each said vane slot contains a stop member which limits the extent of depression of the vanes into the vane-supporting portions of the slots and provides an undervane area for pressure-balancing and undervane pumping purposes.

13. A vane pump according to claim 12 in which said stop member comprises a raised floor portion, adjacent a deeper floor portion providing said undervane area.

14. A vane pump according to claim 1 in which each said manifold bearing has a bearing face surface comprising a major inlet arc segment, a minor discharge arc segment and smaller seal arc segments as transitional segments spacing said inlet and discharge arc segments, and passage means through each said bearing in said seal arc segments for communicating the vane slot extensions of the rotor member with a source of fluid pressurized to a predetermined intermediate pressure.

15. A vane pump according to claim 14 in which the said passage means through said manifold bearings in said seal arc segments are configured to produce substantially symmetrical forces on said unitary cam member throughout the range of adjustment of said cam relative to said vaned rotor.

16. A vane pump according to claim 14 further including a piston adjustment system for adjusting said cam relative to said rotor, wherein said piston adjustment system is actuated by fluid pressure supplied by said source of fluid pressurized to a predetermined intermediate pressure.

17. A vane pump according to claim 14 in which each said manifold bearing has a major inlet arc segment comprising a face surface having a plurality of relatively wide radial inlet recesses spaced by a plurality of relatively narrow stand-off face members, said inlet recesses opening axially into a common inlet chamber having an undervane inlet port at the inner diameter of said bearing.

18. A vane according to claim 14 in which each said manifold bearing has a minor discharge are segment comprising a face surface having axial openings to a discharge chamber having an undervane inlet port at the inner diameter of said bearing and having a discharge port at the outer diameter of said bearing for discharging pressurized fluid from the vane pump.

19. A vane pump according to claim 14 in which each said manifold bearing has a discharge arc segment in the face surface thereof bearing axially against said cam, having relief openings to the exterior for reducing the total pressure-induced force acting on said face, and said bearing further comprises a flange shoulder surface, axially opposite said face surface, that is subjected to pressure-induced force greater than the pressure-induced force acting on said face surface, for enhancing the seal between said cam and said manifold bearings.

* * * * *